United States Patent [19]

Fitch et al.

[11] 4,201,570

[45] May 6, 1980

[54] PROCESS FOR QUENCHING OF FINE PARTICULATES

[75] Inventors: Steven J. Fitch, Baltimore; Charles A. Tanner, Severna Park, both of Md.

[73] Assignee: SCM Corporation, Cleveland, Ohio

[21] Appl. No.: 749,235

[22] Filed: Dec. 10, 1976

[51] Int. Cl.[2] ..... C22B 1/14

[52] U.S. Cl. ..... 75/1 T; 75/3; 75/25; 423/69; 264/117

[58] Field of Search ..... 75/1 T, 3, 25, 112; 423/69; 264/117

[56] References Cited

U.S. PATENT DOCUMENTS

| | | | |
|---|---|---|---|
| 3,118,732 | 1/1964 | Richards et al. | 423/77 |
| 3,120,999 | 2/1964 | Rummery et al. | 423/77 |
| 3,219,411 | 11/1965 | Cheever et al. | 423/77 |
| 3,823,009 | 7/1974 | Lailach et al. | 75/1 T |

*Primary Examiner*—Leland A. Sebastian

*Attorney, Agent, or Firm*—Merton H. Douthitt; Gordon P. Becker; Jerry K. Mueller, Jr.

[57] ABSTRACT

A mass of fine particulates such as chlorinated by-products (often collected as "cyclone solids") from the chlorination of titaniferous material, said particulates comprising hydrolyzable metal halides, are converted to readily-handled granules by hydration and attendant agglomeration as heat and vapors evolve.

8 Claims, No Drawings

PROCESS FOR QUENCHING OF FINE PARTICULATES

BACKGROUND

This invention relates to a process for converting fine particulates comprising hydrolyzable metal halides (including oxyhalides, if present) into readily-handled granules in economical manner.

Typically such particulates today are waste products, eg. chlorinator byproducts (often collected from a cyclone separator, thus "cyclone solids") from the chlorination of titaniferous materials such as a chlorination of rutile or ilmenite ore with coke to make pigmentary $TiO_2$ or the beneficiation of ilmenite ore with chlorine and coke. It is elementary chemistry to expect many metal chlorides to hydrolyze with water. Titanium tetrachloride itself has been hydrolyzed deliberately, for example, to generate $TiO_2$ and HCl.

The term "cyclone solids" is derived from the collection of these fines by cyclone separator from a vapor stream, often out of a fluidized bed reactor, although other conventional reactor and collector types are useful also, so the term need not be construed narrowly. They usually are about 120 mesh (U.S. Standard Sieve) or finer. They dust, often tend to be hygroscopic, and usually fume obnoxiously in humid air to give off some deleterious and corrosive hydrogen chloride. Representative titaniferous ore chlorinator byproducts will contain unreacted (and/or partially reacted) ore, coke, ferrous chloride, ferric chloride, and minor amounts of the chlorides and oxychlorides of vanadium, chromium, niobium, titanium, magnesium, aluminum, silicon, and zirconium (the vanadium usually thought of as being in the vanadyl (VO) form). If sufficient of these wastes can be supplied to a central location, the recovery of at least minor components such as vanadium and/or niobium therefrom can be attractive.

Chlorination of various alumina- and zirconia-bearing material with carbon can give rise to related wastes which can be processed in accordance with the instant invention.

Mechanical agglomeration or granulation assisted by a liquid binding agent such as a very small proportion of water is a well-known practice for use with nonhydrolyzable solids such as carbon black, glass batch components (oxides, carbonates, silicates, and the like), foods, and many other substances. In some instances the water appears to assist in forming nuclei upon which spheres or agglomerates build.

A variety of things must occur to make the instant process practical. Thus, there must be substantial hydrolysis of the metal halides. Concommitant with this is the evolution of heat and corrosive byproduct vapors, the heat evolution being of assistance for removal of a modest excess of water (which is desirable to drive the hydrolysis reaction); and, in addition to the foregoing, agglomeration must occur to make comparatively rugged granules that can be handled readily with safety in covered, preferably steel, equipment with little or no dusting or fuming. The instant process accomplishes these things efficiently and economically. Ambient transit conditions are ambient air temperature and humidity in conventional transporting and storage equipment.

BROAD STATEMENT OF THE INVENTION

The process comprises hydrating the mass of the fine particulate material sufficiently for suppressing dusting and fuming of the resulting solid product at ambient transport conditions without leaving appreciable aqueous liquid in the resulting hydrated mass, subjecting such hydrating mass to agglomeration as it generates heat and evolves vapor, withdrawing vapors, and collecting as product the residual agglomerates or granules. Temperature of the reacting solids often reaches 100°–120° C. and can be higher in localized regions of the agglomerator.

DETAILED DESCRIPTION OF THE INVENTION

Liquid water is the simplest aqueous liquid useful for the hydration. If heat is desirably applied to the mass, at least a part of the water can be in the form of open steam and/or heated water, although this usually is not necessary. To obtain enough water for the hydrating of such chlorinator byproducts, it is advantageous to have about 2–5 parts of water per about 10 parts of such cyclone solids fed, all parts herein being parts by weight. Preferably, for efficiency and economy, in such operation about 3–4 parts of water are used for 10 parts of said fines.

Where there is an aqueous waste liquor on the plant site, such as dilute sulfuric acid, aqueous sodium sulfate, ferrous sulfate, sodium chloride, or the like, this can be used to provide at least a portion of the necessary water in some cases. Wastes containing starch, clay, molasses, etc. (suitably aqueous ones) can be used also for their binding action, but are not needed; their use in this way, however, is a convenient disposal for them with the agglomerated product. Appreciable binding action appears to be exerted by the hydrolysis products being formed.

The sequential character of hydrolysis, vaporization, and dampening is visually evident when using an open-top screw conveyor for this agglomeration. On a pelletizing disc a tumbling pellet repeatedly experiences alternating contact with less consolidated solids and limited moisture during its growth, substantially accomplishing the same effects. In either case the agglomerating solids have time to evolve fumes at elevated temperature; thus, after cooling to transit condition, the product has very little, if any, tendency to fume further, even when the air is humid. The resulting granules are of size to suppress appreciable dusting. The quenching (hydrolysis) to yield little, if any, liquid water phase makes it practical to transport the products in covered steel equipment.

While the hydration could be done with all of the water added at once or substantially at once and in a batch operation, adding it gradually as agglomeration proceeds continuously appears to provide the most economical and controlled processing.

In many instances it is desirable to recover at least a portion of one or more ingredients from the fine particulate chlorinator byproduct before it is subjected to the hydrating process. This, of course, will concentrate the hydrolyzable metal halides in most cases and raise the requisite water ratio for the hydration.

Thus, coke, being the least dense material in such cyclone solids, can be separated, eg. by air classification, and, where various other materials have appreciable density differences, they also can be separated. Separation by magnetic susceptibility and electromagnetic susceptibility also are possible (although the iron content in cyclone solids is not appreciably magnetic). Ores such as ilmenite can take a slight electrical charge and be separated electrostatically from materials that are strongly negatively charged with respect to metals such as brass or steel, eg. quartz and other gangues. Size classification also can be used in some cases if any separation of material is to be practiced prior to the hydration. The product granules of this process can, of course, be crushed or ground and like processing applied for recovery of various values.

There are many pelletizers useful for agglomerating solids, typically pelletizing disc machines, screw conveyor-like mechanisms (open or vented at the top for the instant operation), ribbon blender-like mechanisms, and a myriad of other machines shown, for example, in Patent Office Class 264, Subclass 117. Recently the applicants have used a pelletizing disc operating on the principle of that shown in U.S. Pat. No. 3,966,975, and currently they are experimenting with a screw conveyor which is believed to be more practical and economical. Materials of construction for the apparatus should be corrosion-resistant, eg. ceramic, fiberglass-reenforced plastic, special alloys, etc.

For environmental considerations the fumes from this pelletizing operation must be collected, for example, by scrubbing with water or alkaline water to make muriatic acid or its salts.

The following examples show ways in which the invention has been practiced, but should not be construed as limiting the invention. In this specification all parts are parts by weight, all percentages are weight percentages, and all temperatures are in degrees Centigrade unless otherwise expressly indicated.

EXAMPLE 1

The apparatus used was a substantially horizontal screw contactor open at the top for most of its length, having a feed trough at one end, said trough reached by the screw, and a bottom discharge at the opposite end. The feed trough had raised walls and was 3 feet (about 0.915 meter) long. The contacting section for water spraying was 7 feet (about 2.14 meters) long. The screw had 4-inch (about 10.2 cm.) diameter, solid flights, 4 flights per foot (about 13.1 per meter), and was driven feed trough and conveyor housing by an electric motor at 30 rpm to draw feed from the trough, pass feed through the the water-contacting section, and discharge product from the other end. Seven inches (about 18 cm.) above the contacting section was a manifold of 5 water sprays, the initial two being about one foot (about 0.305 meter) apart and the final three being spaced out at longer intervals up to a final approximately 2-foot (about 0.61 meter) interval. As this was a pilot unit, each spray had a throttle valve on it for adjustment, and the parts of the unit contacting solids were made of steel coated with epoxy resin paint. The nozzles were adjusted to give a flat fan spray along the axis of the screw.

Chlorinator byproducts from the chlorination of rutile ore with coke and elemental chlorine consisted of unreacted and/or partially reacted ore, coke, titanium tetrachloride, and various other metal chlorides, mainly ferrous chloride. The feed trough was filled manually with these solids, 40% coarser than 230 mesh U.S.S., the balance finer, said solids having been collected from a cyclone separator of a chloride process titanium dioxide plant. Initial runs were made with various adjustments of the water rate so that a non-fuming and non-dusting, but only slightly damp product granule (at room temperature) was obtained. Liberated hydrogen chloride and steam were exhausted through a hood over the apparatus, and the feed trough was maintained full until a particular feed sample ran out. Feed rates of 130–260 pounds (about 59–118 kg.) per hour were tested. The feed was at room temperature of about 21°–26° C.

The reaction of water with the metal chlorides in the feed is exothermic; spot temperatures of about 220° F. (104° C.) were measured in the reacting solids in the conveyor. HCl was given off, and the heat tended to dry the solids as they traversed the conveyor. Approximately a third of a pound of water per pound of solids was required to render these particular solids non-fuming and agglomerated to be non-dusting. They came out of the conveyor in warm condition. (Higher metal chloride content in the feed, of course, would require more water). The product solids for the most part were friable agglomerates less than about one-fourth inch (about 0.635 cm.) in diameter, and they had bulk density from about 30–50 pounds per cubic foot (about 0.23–0.39 kg./liter). Data from an exemplary pilot run was as follows.

| Parameter | Feed | Product |
|---|---|---|
| % chlorine (soluble in nitric acid) | 26.58 | 16.09 |
| % moisture (dried at 105° for 4 hours) | — | 12.14 |
| % HCl insolubles (10% aqueous HCl) | 40.63 | 47.09 |
| % loss on ignition of insolubles (538° C.) | 34.44 | 21.15 |
| % total Fe | 6.55 | 6.91 |
| Bulk density, pounds per cubic foot | 32.42 (about 0.25 kg./1.) | 45.01 (about 0.35 kg./1.) |

EXAMPLE 2

In this series of experiments a rotating pan pelletizer machine (a 16-inch "Demo Disk" manufactured by Ferrotech, Inc., Pittsburgh, Pennsylvania) was used. The stainless steel pan rotated at 30 rpm at an angle inclined 40° from the vertical, and it was fed by a 1-inch (2.54 cm.) solid flight screw feeder. Depth of the rotary pan was 3 inches (7.6 cm.). Unquenched solids similar of the previous example were fed to the pan through the feeder. The pan was sprayed with water adjusted to make the feed form into pellets, but not to become overly damp. Pellets formed on the pan and cascaded over the rim thereof. They were spherical and ranged from three-eighths inch (0.95 cm.) diameter solids to smaller friable agglomerates. The pelletized product was non-fuming and non-dusting at room temperature. Liberated HCl and steam were collected in a hood above the apparatus. Water consumption was approximately one-third of a pound of water per pound of feed and could be varied appreciably to make a satisfactory product. Data from an exemplary run is given below.

| Parameter | Feed | Product |
|---|---|---|
| % HCl insolubles (aqueous HCl) | 71.70 | 55.66 |
| % loss on ignition of insolubles (538° C.) | 37.52 | 36.08 |
| % total Fe | 6.67 | 4.54 |
| % bulk density (pounds | — | 44.11 |

-continued

| Parameter | Feed | Product |
|---|---|---|
| per cubic foot) | | (0.34 kg./liter) |

We claim:

1. A process for quenching and agglomerating a mass of fine particulate material containing hydrolyzable metal halides which comprises:

hydrating said mass sufficiently for suppressing dusting and fuming at ambient transport conditions without leaving appreciable aqueous liquid in the resulting hydrated mass;

subjecting the hydrating mass to agglomeration as it generates heat and evolves vapor;

withdrawing said vapor; and collecting as product the residual agglomerates.

2. The process of claim 1 wherein the mass of fine particulates is obtained from chlorination of titaniferous materials in the presence of carbon.

3. The process of claim 1 wherein the hydration is done with liquid water.

4. The process of claim 3 wherein said liquid water is from an aqueous waste liquor.

5. The process of claim 1 wherein the hydration is done at least inpart with steam.

6. The process of claim 2 wherein coke is recovered from the mass of fine particulate material prior to its hydration.

7. The process of claim 2 wherein the mass of fine particulate material is mixed with water in the ratio of about 2–5 parts of water per 10 parts of said material.

8. The process of claim 7 wherein said mixing is done with 3–4 parts of water per 10 parts of said fines, and the evolved vapors are scrubbed with aqueous HCl absorbent.

* * * * *